United States Patent [19]

Mori et al.

[11] Patent Number: 4,918,813

[45] Date of Patent: Apr. 24, 1990

[54] METHOD OF SHAPING PLUG RECEPTACLE

[75] Inventors: Akio Mori; Kazuhiro Watanabe; Shoichi Mochizuki, all of Goenba, Japan

[73] Assignee: Yazaki Corporation, Tokyo, Japan

[21] Appl. No.: 382,949

[22] Filed: Jul. 21, 1989

[30] Foreign Application Priority Data

Aug. 23, 1988 [JP] Japan ..... 63-207396

[51] Int. Cl.[5] ..... H01R 43/16

[52] U.S. Cl. ..... 29/874; 29/882; 439/78; 439/857

[58] Field of Search ..... 29/874, 882; 439/78, 439/857

[56] References Cited

U.S. PATENT DOCUMENTS

| | | | |
|---|---|---|---|
| 3,675,320 | 7/1972 | Watanabe | 29/874 |
| 3,947,083 | 3/1976 | Ahmed et al. | 439/857 |
| 4,546,542 | 10/1985 | Proud | 29/882 X |
| 4,606,599 | 8/1986 | Grant et al. | 439/857 |

FOREIGN PATENT DOCUMENTS

| | | | |
|---|---|---|---|
| 843797 | 8/1960 | United Kingdom | 439/78 |
| 1242283 | 8/1971 | United Kingdom | 439/78 |

*Primary Examiner*—Carl J. Arbes

*Attorney, Agent, or Firm*—Sughrue, Mion, Zinn, Macpeak & Seas

[57] ABSTRACT

A method for providing a receptacle includes the steps of: providing a stamped blank having a strip-like conductor which includes longitudinal edges (7), a resilient contact plate, a connective plate having a first portion and a second portion, and at least one projection: a first bending step for bending the extension such that flat surfaces of the projection are perpendicular to flat surfaces of the resilient contact plate; a second bending step, conducted after the first bending step, for bending the first portion of said conductive plate such that flat surfaces of the resilient contact plate are perpendicular to flat surfaces of the strip-like conductor; and a third bending step, conducted after the second bending step, for bending the first portion of the connective plate such that the flat surfaces of the at least one projection are perpendicular to the flat surfaces of the strip-like conductor.

6 Claims, 4 Drawing Sheets

METHOD OF SHAPING PLUG RECEPTACLE

FIELD OF THE INVENTION

This invention relates to a receptacle for receiving a plug of, for example, a switch or a relay, and also to a method of shaping such a receptacle.

BACKGROUND OF THE INVENTION

Referring to FIG. 1, a known receptacle 2 of this general type is shown. The receptacle 2 includes a strip-like conductor 1 formed integrally therewith. The receptacle 2 also includes a resilient contact plate 3 for contact with a flat surface of a flat-type plug A, and finger-shaped projections 5 and 5' extending from the opposite sides of the contact plate 3 through extensions 4 which are bent. The flat surfaces of the finger-shaped projections 5 and 5' are disposed perpendicular to the flat surfaces of the contact plate 3, and rounded heads 6 of the projections 5 and 5' are adapted to press against the other flat surface of the plug A. The contact plate 3 extends integrally from one end of the conductor 1. The plug A is adapted to be inserted into the receptacle in such a manner that the flat surfaces of the plug A are disposed perpendicular to longitudinal edges 7 of the conductor 1.

Referring to FIG. 2, the receptacle 2 of FIG. 1 is shaped by bending a stamped blank m along bending lines 8*a* to 8*c* indicated by broken lines.

When the strip-like conductor 1 is to be used as a bus bar circuit for a circuit board mounted within an electric connection box, it is often required, because of the limitations on the arrangement of the circuit and the direction of insertion of the flat-type plug A, to provide, as shown in FIG. 3, a receptacle 2' to which the plug A is adapted to be connected in such a manner that the plug A is disposed in parallel relation to the longitudinal edges 7 of the conductor 1.

FIGS. 4(*a*) to 4(*d*) show the steps of shaping the receptacle 2' of FIG. 3. First, as shown in FIGS. 4(*a*) and (*b*), on finger-shaped projection 5' of a blank m' is bent, using upper and lower dies 9 and 9'. At this time, since the contact plate 3 and the other finger-shaped projection 5 are supported by the lower die 9', the finger-shaped projection 5' is positively bent. However, as a result of the bending of the finger-shaped projection 5', when the contact plate 3 is to be bent relative to the other finger-shaped projection 5, using upper and lower dies 10 and 10' (FIGS. 4(*c*) and 4(*d*)), that portion 10*a'* of the lower die 10' supporting the extension 4 is so small and inadequate that a positive bending cannot be achieved. Therefore, a precision at this region (and hence a proper gap between the resilient contact plate 3 and a rounded head 6 of the finger-shaped projection 5) is affected, thus degrading the performance of the resultant receptacle 2'.

In order that the flat-type plug A can be inserted into a receptacle 2', with the flat surfaces of the plug A disposed in parallel relation to the longitudinal edges 7 of the conductor 1, when the finger-shaped projection 5 or the finger-shaped projection 5' is bent relative to that portion of the blank m' disposed forwardly of the conductor 1 as shown in FIG. 4(*a*), a positive bending cannot be achieved, thus adversely affecting the precision and performance of the receptacle.

SUMMARY OF THE INVENTION

Accordingly, an object of this invention is to provide a receptacle free from the drawbacks associated with the known receptacle, and also to provide a method of shaping such a receptacle. The present invention accomplishes these and other objects by a method of shaping a receptacle, the method including the steps of:

providing a connective plate at one end of a strip-like conductor, the connective plate having a first portion disposed perpendicular to longitudinal edges of the conductor and a second portion disposed parallel to the longitudinal edges;

providing a stamped blank which has a resilient contact plate extending from the second portion of the connective plate, and finger-shaped projections extending respectively from opposite sides of the resilient contact plate through respective extensions;

bending the extensions in such a manner that flat surfaces of the finger-shaped projections are disposed perpendicular to flat surfaces of the resilient contact plate of the blank;

subsequently bending the first portion of the connective portion in such a manner that the flat surfaces of the resilient contact plate are disposed perpendicular to flat surfaces of the conductor; and subsequently further bending the first portion of the connective plate into an upstanding condition in such a manner that the flat surfaces of the finger-shaped projections are disposed perpendicular to the flat surfaces of the conductor.

PREFERRED EMBODIMENTS OF THE INVENTION

Figure 1:
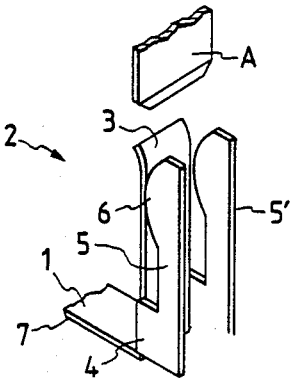
FIG. 1 is a perspective view of a known receptacle.
Figure 2:
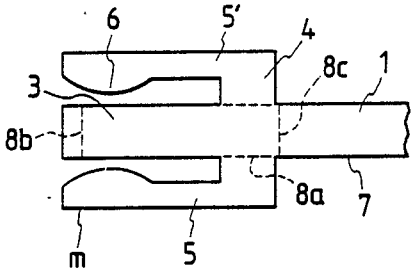
FIG. 2 PRIOR ART
FIG. 2 is a developed view of the receptacle of FIG. 1.
Figure 3:
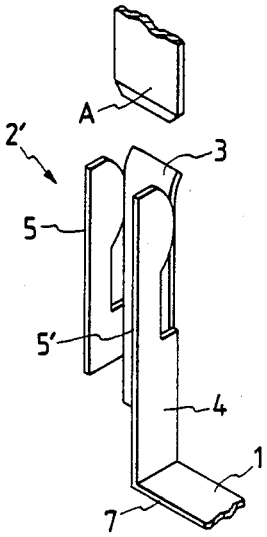
FIG. 3 PRIOR ART
FIG. 3 is a perspective view of another known receptacle.
Figure 4A:
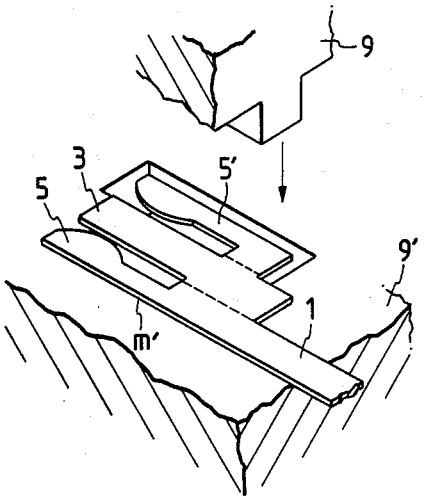
FIG. 4(a) PRIOR ART
FIG. 4(*a*) to 4(*d*) are views illustrative of the steps of shaping the receptacle of FIG. 2.
Figure 4B:
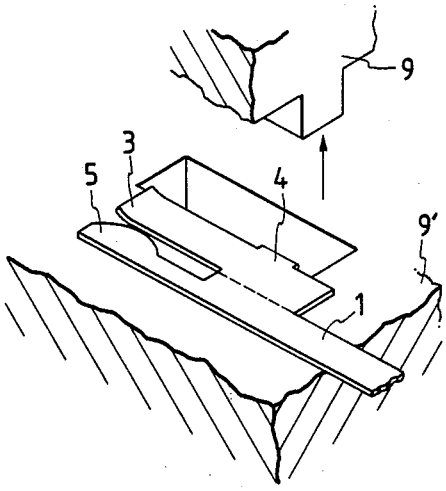
FIG. 4(b) PRIOR ART
Figure 4C:
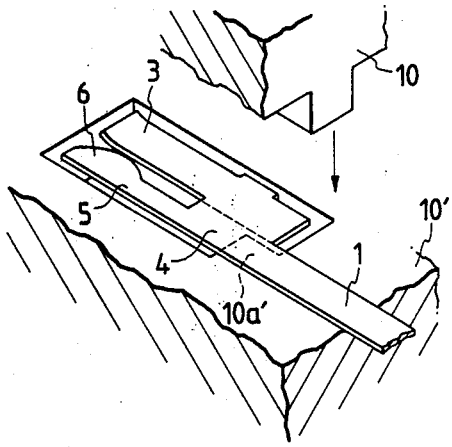
FIG. 4(c) PRIOR ART
Figure 4D:
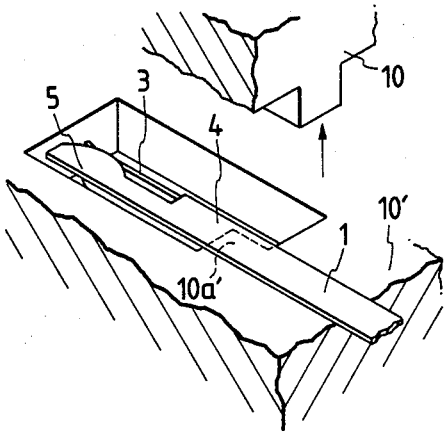
FIG. 4(d) PRIOR ART
Figure 5:
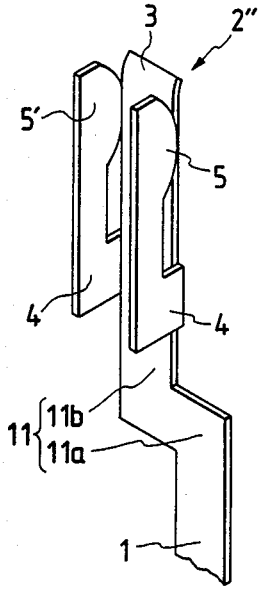
FIG. 5 is a perspective view of a preferred embodiment of a receptacle of the present invention.
Figure 6B:
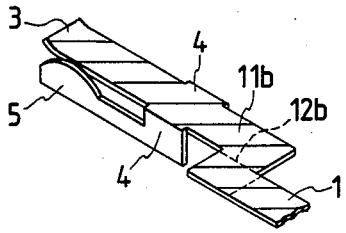
FIGS. 6(*a*) to 6(*d*) are views illustrative of the steps of a receptacle shaping method of the present invention.
Figure 6C:
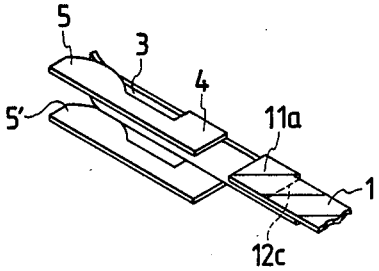
Figure 6A:
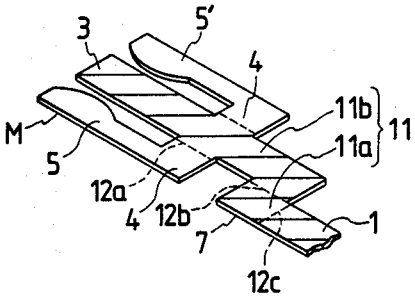
Figure 6D:
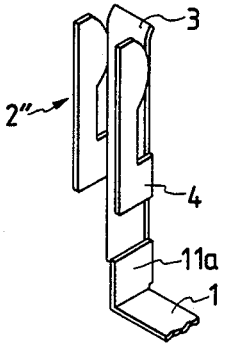
Figure 7A:
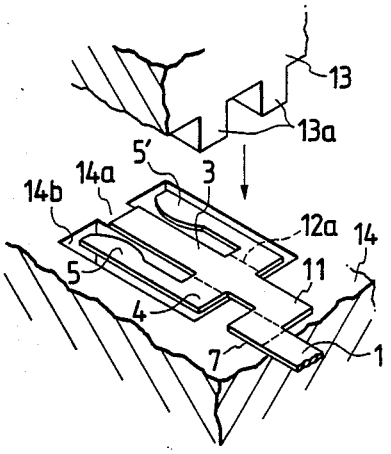
FIGS. 7(*a*) to 7(*d*) are views illustrative of the steps of shaping the receptacle, using dies.
Figure 7B:
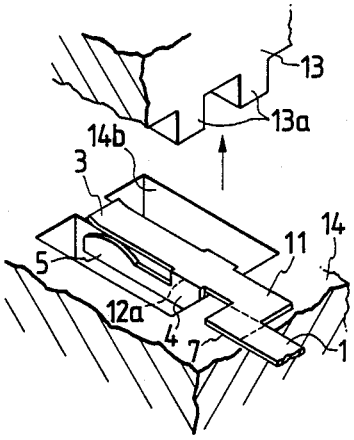
Figure 7C:
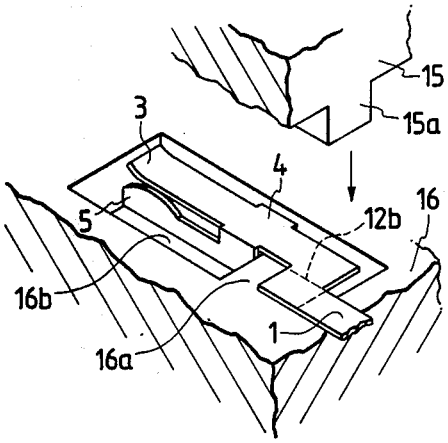
Figure 7D:
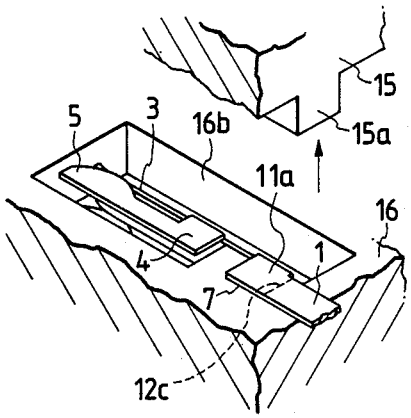

As shown in FIG. 5, a receptacle 2'' of the present invention has a resilient contact plate 3 extending from a strip-like conductor 1 through an L-shaped connective plate 11 extending from one end of the conductor 1, the contact plate 3 extending in parallel relation to the conductor 1. Finger-shaped projections 5 and 5' extend respectively from opposite sides of the resilient contact plate 3 through respective extensions 4, the projections 5 and 5' being disposed perpendicular to the contact plate 3. A flat-type plug is adapted to be inserted into a space between the resilient contact plate 3 and the edges of the finger-shaped projections 5 and 5' The L-shaped connective plate 11 is suitably bent as needed. Only one of the finger-shaped projections 5 and 5' may be provided in which case the finger-shaped projection 5 or 5' is bent intermediate opposite ends thereof so that the bent portion is disposed in opposed relation to the central portion of the resilient contact plate 3.

Referring to FIGS. 6(*a*)–6(*d*) a receptacle shaping method according to the present invention is shown. Those portions in FIGS. 6(*a*)–6(*d*) indicated by hatching are supported on a lower die (described later) when shaping the receptacle, and broken lines 12*a* to 12*c* indicate lines of bending. In FIG. 6(*a*), there is provided a stamped blank M which includes the connective plate 11 extending from the end of the strip-like conductor 1 and having a portion 11*a* disposed perpendicular to the longitudinal edges 7 of the conductor 1 and a portion 11*b* disposed parallel to the longitudinal edges 7. The resilient contact plate 3 extends from the portion 11*b* of the connective plate 11, and the finger-shaped projections 5 and 5' extends respectively from the opposite sides of the resilient contact plate 3 through respective extensions 4. The extensions 4 are bent in such a manner that the flat surfaces of the finger-shaped projections 5 and 5' are disposed perpendicular to the flat surfaces of the resilient contact plate 3 of the blank M as shown in FIG. 6(*b*). Then, the portion 11*a* of the connective plate 11 is bent in such a manner that the flat surfaces of the resilient contact plate 3 are disposed perpendicular to the flat surfaces of the conductor 1 as shown in FIG. 6(*c*). Further, the portion 11*a* of the connective plate 11 is bent into an upstanding condition in such a manner that the flat surfaces of the finger-shaped projections 5 and 5' are disposed perpendicular to the flat surfaces of the conductor 1 as shown in FIG. 6(*d*).

Thus, there is provided the receptacle 2'' into which the flat-type plug A can be inserted in a direction parallel to the longitudinal edges 7 of the conductor 1.

FIGS. 7(*a*) to 7(*d*) show the steps of shaping the above receptacle with the use of dies. In FIG. 7(*a*), reference numeral 13 denotes an upper die, and reference numeral 14 denotes the lower die. The lower die 14 has recesses 14*b* on opposite sides of a support portion 14*a* for supporting the resilient contact plate 3. The recesses 14*b* enable the perpendicular bending of the finger-shaped projections 5 and 5'. The upper die 13 has convex portions 13*a* which is formed on its surface facing the lower die and correspond to the respective recesses 14*b*. The transverse width of the support portion 14*a* is slightly greater than that of the resilient contact plate 3, and is equal to the dimension between the bending lines 12*a* along which the extensions 4 are bent, respectively. When the upper die 13 is moved downward with the resilient contact plate 3 resting on the support portion 14*a*, the finger-shaped projections 5 and 5' are pressed by the convex portions 13*a* and are perpendicularly bent along the bending lines 12*a* relative to the contact plate 3 as shown in FIG. 7(*b*).

Then, as shown in FIG. 7(*c*), using a lower die 16 (which has a support portion 16*a* for supporting the end portion of the conductor 1 and also has a recess 16*b* for enabling the bending of that portion of the receptacle 2'' including the connective plate 11) and an upper die 15 having a convex portion 15*a*, the bending along the bending line 12*b* is effected, so that the flat surfaces of the resilient contact plate 3 are brought into perpendicular relation to the flat surfaces of the conductor 1 (FIG. 7(*d*)), thus obtaining the configuration shown in FIG. 6(*c*).

In this condition, the end portion of the conductor 1 is perpendicularly bent along the bending line 12*c*, using a die (not shown), as shown in FIG. 6(*d*), thereby providing the receptacle 2'' disposed in upstanding relation to the conductor 1.

Since the stamped blank M for forming the receptacle is connected to the end of the strip-like conductor 1 through the connective plate 11 as shown in FIG. 6(*a*), the opposite finger-shaped projections 5 and 5' can be positively bent, with the conductor 1 and the contact plate 3 always supported on the lower die 14, when bending and shaping the receptacle 2''. Therefore, the shaping precision and the performance of the receptacle 2'' can be enhanced.

Whether the flat surfaces of the flat-type plug A adapted to be inserted into the receptacle are disposed perpendicular to or parallel to the longitudinal edges 7 of the conductor 1 is determined depending on whether the portion 11*a* of the connective plate 11 is bent or not. Therefore, the selection of the direction of insertion of the flat-type plug A into the receptacle can be made without being influenced by the arrangement of the conductor 1.

As described above, according to the present invention, the shaping precision and the performance of the receptacle formed integrally with the conductor can be enhanced, and also the selection of the direction of insertion of the flat-type plug into the receptacle can be made without being influenced by the arrangement of the conductor.

What is claimed is:

1. A method of shaping a receptacle, comprising the steps of:

providing a connective plate (11) at one end of a strip-like conductor (1), the connective plate having a first portion (11*a*) disposed perpendicular to longitudinal edges (7) of said conductor and a second portion (11*b*) disposed parallel to the longitudinal edges;

providing a stamped blank (M) having a resilient contact plate (3) extending from said second portion of said connective plate, and finger-shaped projections (5, 5') extending respectively from opposite sides of said resilient contact plate through respective extensions (4);

bending said extensions in such a manner that flat surfaces of said finger-shaped projections are disposed perpendicular to flat surfaces of said resilient contact plate;

subsequently bending said first portion of said connective plate in such a manner that the flat surfaces of said resilient contact plate are disposed perpendicular to flat surfaces of said strip-like conductor; and subsequently further bending the first portion of said connective plate such that the flat surfaces of the finger-shaped projections are perpendicular to the flat surfaces of said strip-like conductor.

2. The method as defined in claim 1, wherein said bending steps are performed with dies.

3. A method of shaping a plug receptacle comprising the steps of:

a providing a stamped blank (M) comprising a strip-like conductor (1) having longitudinal edges (7), a resilient contact plate (3), and a connective plate (11) extending from an end of the strip-like conductor, the connective plate having a first portion (11*a*) which is perpendicular to the longitudinal edges of said strip-like conductor and having a second portion (11*b*) which is parallel to the longitudinal edges, the stamped blank further comprising at least one projection (5,5') extending from a side of said resilient contact plate through an extension (4);

a first bending step for bending said extension such that flat surfaces of the at least one projection are perpendicular to flat surfaces of said resilient contact plate;

a second bending step, conducted after the first bending step, for bending the first portion of said connective plate such that the flat surfaces of said resilient contact plate are perpendicular to flat surfaces of said strip-like conductor; and a third bending step, conducted after the second bending step, for bending the first portion of said connective plate such that the flat surfaces of the at least one projection are perpendicular to the flat surfaces of the strip-like conductor.

4. The method as defined in claim 3, wherein the provided stamped blank includes two projection extending from opposite sides of said resilient contact plate.

5. The method as defined in claim 3, wherein said first bending step comprises the steps of:

placing the provided stamped blank on a first lower die (14) having at least one recess (14*b*) corresponding to the at least one projection, and having a support portion (14*a*) for supporting the resilient contact plate; and moving a first upper die (13) having at least one convex portion (13*a*) formed on the surface thereof and corresponding to the at least one recess of the first lower die, such that the at least one convex portion contacts and bends the at least one projection until the surfaces of the at least one projection are perpendicular to the surfaces of said contact plate.

6. The method as defined in claim 5, wherein said second bending step comprises the steps of:

placing the stamped blank on a second lower die (16) having a support portion (16*a*) for supporting an end portion of said conductor and having a recess (16*b*); and moving an second upper die (15) having a convex portion (15*a*) into said recess portion of said second lower die so that the flat surfaces of said resilient contact plate are perpendicular to the flat surfaces of said conductor.

* * * * *